US009742072B2

(12) United States Patent
Jünemann

(10) Patent No.: US 9,742,072 B2
(45) Date of Patent: Aug. 22, 2017

(54) PRINTED CIRCUIT BOARD ARRANGEMENT FOR SUPPLYING ANTENNAS VIA A THREE-CONDUCTOR SYSTEM FOR EXCITING DIFFERENT POLARIZATIONS

(71) Applicant: Rohde & Schwarz GmbH & Co. KG, Munich (DE)

(72) Inventor: Ralf Jünemann, Munich (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 24 days.

(21) Appl. No.: 14/355,970

(22) PCT Filed: Feb. 15, 2013

(86) PCT No.: PCT/EP2013/053077
§ 371 (c)(1),
(2) Date: May 2, 2014

(87) PCT Pub. No.: WO2013/120994
PCT Pub. Date: Aug. 22, 2013

(65) Prior Publication Data

US 2014/0300521 A1 Oct. 9, 2014

(30) Foreign Application Priority Data

Feb. 15, 2012 (DE) ..... 10 2012 202 261
Jun. 19, 2012 (DE) ..... 10 2012 012 171

(51) Int. Cl.
*H01Q 13/10* (2006.01)
*H01Q 19/02* (2006.01)
(Continued)

(52) U.S. Cl.
CPC ..... *H01Q 19/02* (2013.01); *H01Q 1/38* (2013.01); *H01Q 1/50* (2013.01); *H01Q 5/378* (2015.01); *H01Q 13/08* (2013.01); *H01Q 13/10* (2013.01)

(58) Field of Classification Search
CPC ..... H01Q 13/10; H01Q 1/38; H01Q 13/08; H01Q 5/378
(Continued)

(56) References Cited

U.S. PATENT DOCUMENTS 4,218,682 A * 8/1980 Frosch ..... H01Q 5/40 343/700 MS
5,001,492 A 3/1991 Shapiro et al.
(Continued)

FOREIGN PATENT DOCUMENTS

DE 10 2006 023123 A1 1/2007
EP 1 684 382 A1 7/2006
(Continued)

OTHER PUBLICATIONS

Padhi et al, "A Dual Polarized Aperture Coupled Circular Patch Antenna Using a C-Shaped Coupling Slot", IEEE Transactions on Antennas and Propagation, vol. 51, No. 12, Dec. 2009, pp. 3295-3298.
(Continued)

*Primary Examiner* — Dameon E Levi
*Assistant Examiner* — Hasan Islam
(74) *Attorney, Agent, or Firm* — Carter, DeLuca, Farrell & Schmidt, LLP

(57) ABSTRACT

The printed-circuit board arrangement is used for the electrical connection of an amplifier unit to at least two antenna elements, whereas the at least two antenna elements are embodied on the printed-circuit board arrangement. The antenna elements are coupled via a three-line system to the
(Continued)

Figure 1A:
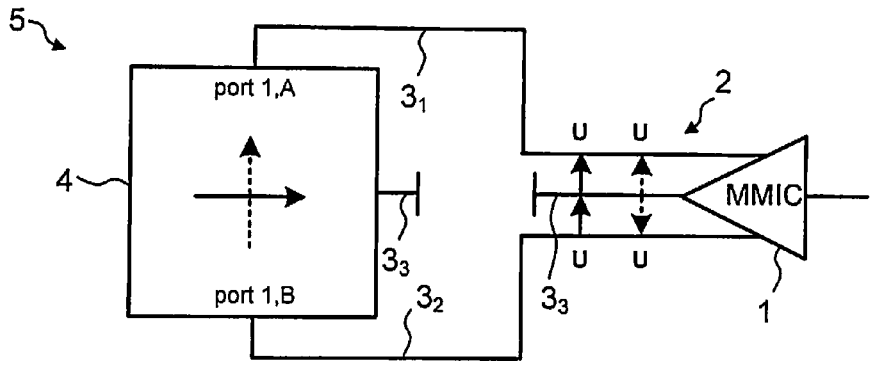

amplifier unit, where the three-line system comprises three strip lines mounted on the printed-circuit board arrangement extending parallel to one another.

14 Claims, 5 Drawing Sheets

(51) Int. Cl.

| | |
|---|---|
| ***H01Q 1/38*** | (2006.01) |
| ***H01Q 13/08*** | (2006.01) |
| ***H01Q 1/50*** | (2006.01) |
| ***H01Q 5/378*** | (2015.01) |

(58) Field of Classification Search
USPC ..... 343/853, 905, 770, 700 MS, 893
See application file for complete search history.

(56) References Cited

U.S. PATENT DOCUMENTS

| | | | | |
|---|---|---|---|---|
| 5,448,250 | A * | 9/1995 | Day | H01Q 1/1271 343/700 MS |
| 6,008,763 | A * | 12/1999 | Nystrom | H01Q 21/08 343/700 MS |
| 7,675,466 | B2 * | 3/2010 | Gaucher | H01Q 21/0006 343/700 MS |
| 7,764,236 | B2 * | 7/2010 | Hill | H01Q 1/243 343/702 |
| 9,007,275 | B2 * | 4/2015 | Pros | H01Q 1/245 343/702 |
| 2004/0239567 | A1 * | 12/2004 | Van Der Poel | H01Q 9/0414 343/700 MS |
| 2006/0132373 | A1 | 6/2006 | Yuanzhu | |
| 2011/0309899 | A1 | 12/2011 | Leiba et al. | |

FOREIGN PATENT DOCUMENTS

| | | | |
|---|---|---|---|
| WO | 2008/111914 | A1 | 9/2008 |
| WO | 2011/112453 | A1 | 9/2011 |

OTHER PUBLICATIONS

Adrian et al., "Dual Aperture-Coupled Microstrip Antenna for Dual or Circular Polarisation", Electronic Letters, Nov. 5, 1987, vol. 23, No. 23, pp. 1226-1228.

Chen, "CPW-Fed Circularly Polarized 2×2 Sequentially Rotated Patch Antenna Array", Microwave Conference Proceedings, APMC 2005, vol. 4, pp. 1-3.

International Search report issued in corresponding application No. PCT/EP2013/053077 on Jun. 3, 2013.

* cited by examiner

PRINTED CIRCUIT BOARD ARRANGEMENT FOR SUPPLYING ANTENNAS VIA A THREE-CONDUCTOR SYSTEM FOR EXCITING DIFFERENT POLARIZATIONS

The invention relates to a printed-circuit board arrangement with at least one amplifier unit and at least two antenna elements, which are fed via a three-line system and preferably operate in the frequency range of millimeter waves. In particular, the arrangement is suitable for use in antenna arrays with several hundred or thousand antennas, which are capable of radiating different, mutually orthogonal polarisations.

Printed-circuit board arrangements which are used in the named context serve to connect different antenna elements to the corresponding amplifier unit. In this context, the printed-circuit board arrangements should be designed so that the overall system can be constructed to be as compact as possible and the space requirement respectively the associated costs can be reduced to a minimum.

"Dual Aperture-Coupled Microstrip Antenna for Dual or Circular Polarisation", A. Adrian and D. H. Schaubert, Electronic Letters, 5, Nov. 1987, Volume 23, No. 23, pages 1226-1228 describes a printed-circuit board arrangement on which antenna elements are arranged which excite a patch in order to radiate orthogonal linear polarisations or orthogonal circular polarisations. The disadvantage with the above-named publication is that the two microstriplines feeding the antenna elements are arranged perpendicular to one another in order to achieve a maximum mutual decoupling. This leads to an increased space requirement with the associated costs. In the case of circular polarisations, a configuration of the antenna arrangement with a phase-shifting power splitter, for example, a 90° ring hybrid, which further increases the space requirement and the costs, is additionally required.

The object of the invention is therefore to provide a printed-circuit board arrangement which is constructed in a more compact manner and is therefore more favourable in manufacture and equally suitable for frequencies in the millimeter-wave range. In particular, the invention is suitable for use in antenna arrays with several hundred or thousand antennas, which are capable of transmitting mutually different orthogonal polarisations.

This object is achieved with regard to the printed-circuit board arrangement by the features of claim 1. The dependent claims specify advantageous further developments of the printed-circuit board arrangement according to the invention.

The printed-circuit board arrangement according to the invention is used for the electrical connection of an amplifier unit to at least two antenna elements, where the at least two antenna elements are embodied on the printed-circuit board arrangement. The at least two antenna elements are accordingly coupled to the amplifier unit via a three-line system, where the three-line system comprises three strip lines extending parallel to one another mounted on the printed-circuit board arrangement or introduced into the printed-circuit board arrangement.

It is particularly advantageous that the printed-circuit board arrangement comprises at least two antenna elements, because a horizontal and a vertical polarisation, and also a left-hand or respectively right-hand circular polarisation are possible in this case. Moreover, it is particularly advantageous that the at least two antenna elements are coupled to the amplifier unit by means of a three-line system. In fact, such a three-line system which comprises three strip lines extending parallel to one another and can guide two mutually orthogonal modes allows a very compact structure of the overall printed-circuit board arrangement.

Furthermore, an advantage is achieved with the printed-circuit board arrangement according to the invention if the at least two antenna elements are slot antennas, and if each slot antenna is formed respectively by an aperture on a second metal layer of the printed-circuit board arrangement, and/or if the two apertures continue from the antenna elements in the direction towards the amplifier unit and accordingly separate the three strip lines extending parallel to one another electrically from one another. This allows a very compact structure, whereas the three-line system excites the two antenna elements embodied as slot antennas in an advantageous manner.

Furthermore, an advantage is achieved with the printed-circuit board arrangement according to the invention if the part of the first aperture which forms the first antenna element is preferably arranged orthogonally to the part of the second aperture which forms the second antenna element, so that the first antenna element is orientated orthogonally to the second antenna element, and/or if the first antenna element has the same shape and the same length as the second antenna element. As a result of the fact that the two antenna elements are preferably orientated orthogonally to one another, it is possible to excite them with a horizontal polarisation or a vertical polarisation or a left-hand circular respectively a right-hand circular polarisation.

Additionally, an advantage is achieved with the printed-circuit board arrangement according to the invention, if a plurality of via holes is arranged in a circular ring and encloses the two antenna elements, whereas the circular ring comprising the plurality of via holes provides no via holes in the direction towards the three-line system. In this context, the plurality of via holes ensures that the electromagnetic field transmitted from the two antenna elements is not coupled into other strip lines or components in the printed-circuit board arrangement.

Additionally, an advantage is achieved with the printed-circuit board arrangement according to the invention if a first patch is embodied on a third metal layer which is arranged above the two antenna elements, or if a first patch is embodied on a first metal layer which is arranged below the two antenna elements, whereas the first patch is isolated by apertures within the first metal layer from the latter.

In the context of this application, a patch is understood to mean a metallised area which is limited in its dimensions and which is resonant within the given arrangement for the desired frequency range.

A further advantage of the printed-circuit board arrangement according to the invention is achieved if the first patch has the shape of a rhombus or preferably a square, where a first edge of the first patch extends parallel to a first antenna element and where a second edge of the first patch, which is adjacent to the first edge of the first patch, extends parallel to a second antenna element. This embodiment of the first patch means that the electromagnetic wave can be radiated in an optimum manner.

Furthermore, an advantage is achieved with the printed-circuit board arrangement according to the invention if a second patch is arranged above the first patch which is arranged above the at least two antenna elements, where the two patches are separated respectively from each other and from the at least two antenna elements by a dielectric. The use of a second patch increases the useful bandwidth.

Additionally, an advantage is achieved with the printed-circuit board arrangement according to the invention if an enclosed metal layer which acts as a reflector is present above or below the at least two antenna elements opposite to the patch. As a result, the directivity of the antenna arrangement can be improved.

Moreover, an advantage is achieved with the printed-circuit board arrangement according to the invention if a recess is embodied in the first substrate of the printed-circuit board arrangement which carries the three-line system, and if the amplifier unit is inserted into this recess. In this case, the connections between the amplifier unit and the three-line system can be kept as short as possible, whereby minimising any reflections occurring.

Additionally, an advantage is achieved with the printed-circuit board arrangement according to the invention if the amplifier unit is capable of applying a signal respectively to the two outer lines with the middle line as the common line of the three-line system, in such a manner that the two antenna elements together with the first patch and optionally with the second patch generate an electromagnetic field with a horizontal polarisation or a vertical polarisation or a left-hand circular respectively right-hand circular polarisation.

Finally, an advantage is achieved with the printed-circuit board arrangement according to the invention if the at least two antenna elements are embodied on the printed-circuit board arrangement and orientated orthogonally to one another. In this context, the two antenna elements need not necessarily be orientated exactly orthogonally to one another. Moreover, deviations from a 90°-angle are also permissible.

Figure 1B:
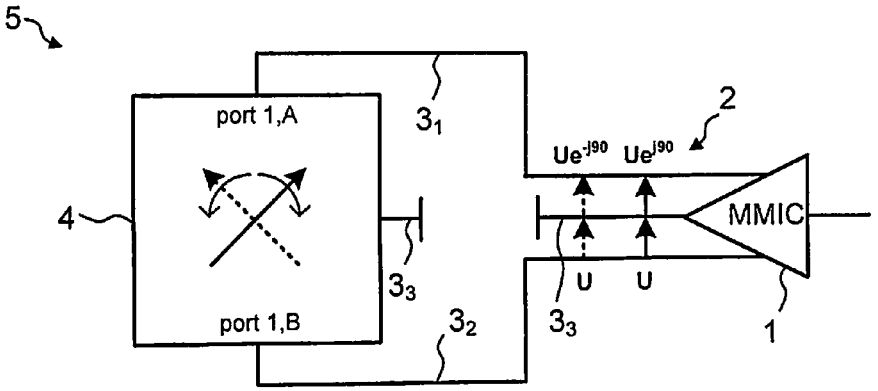
Figure 1C:
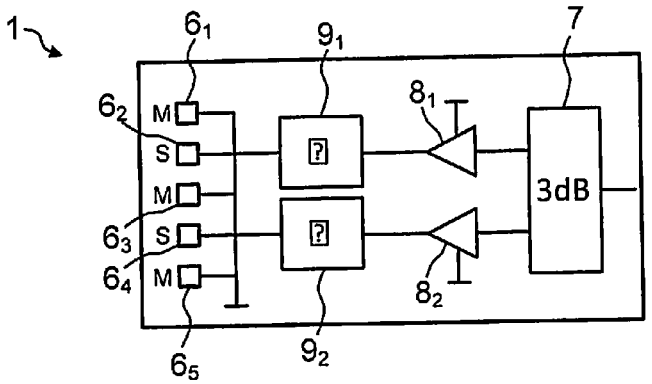
Figure 2A:
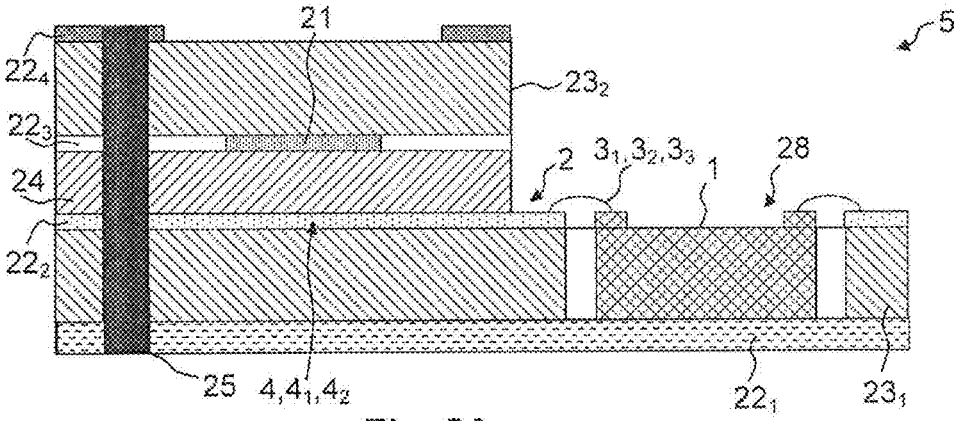
Figure 2B:
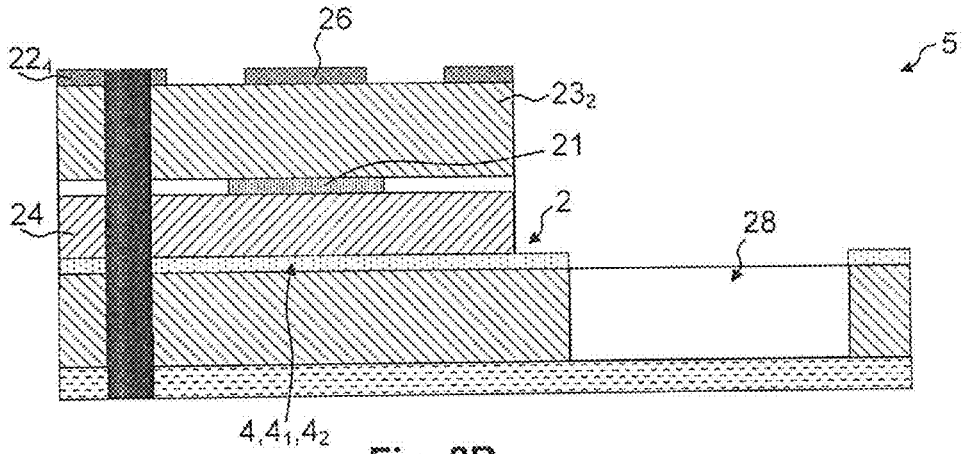
Figure 2C:
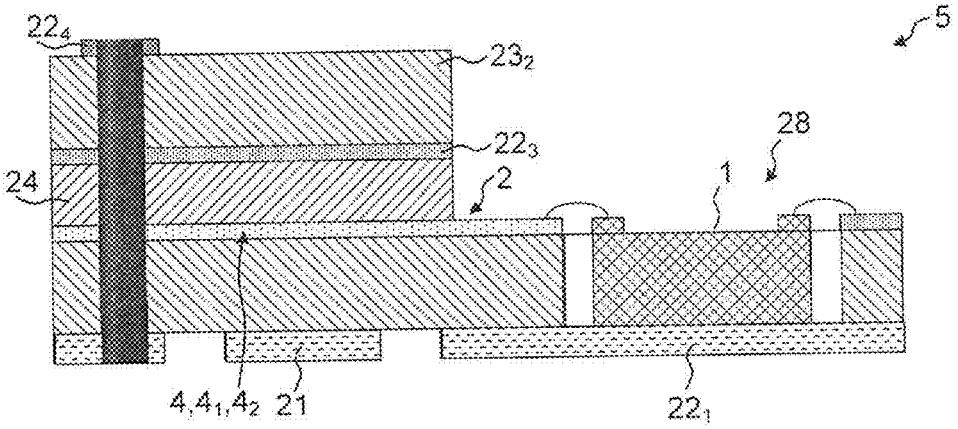
Figure 3A:
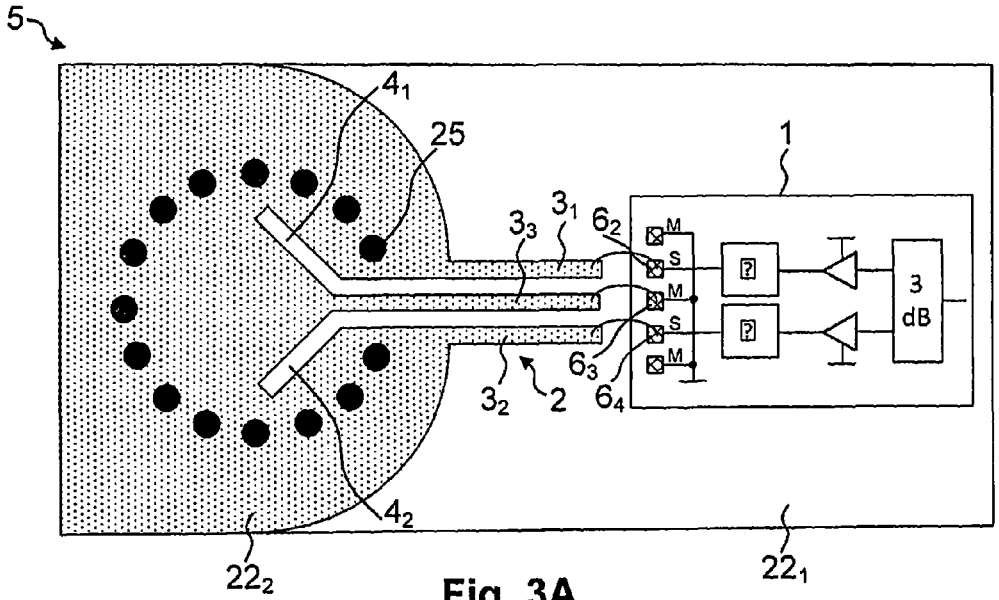
Figure 3B:
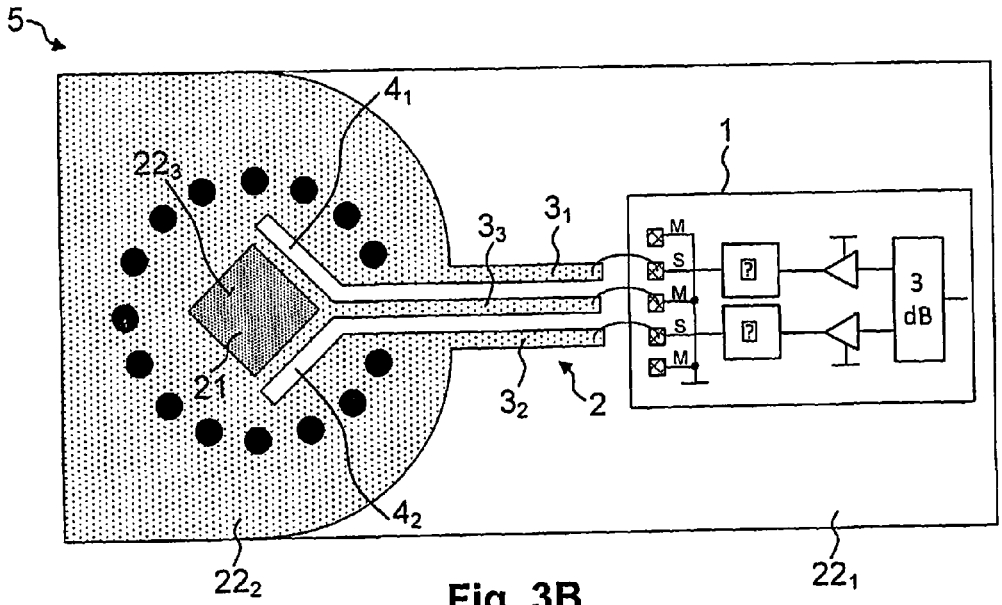
Figure 3C:
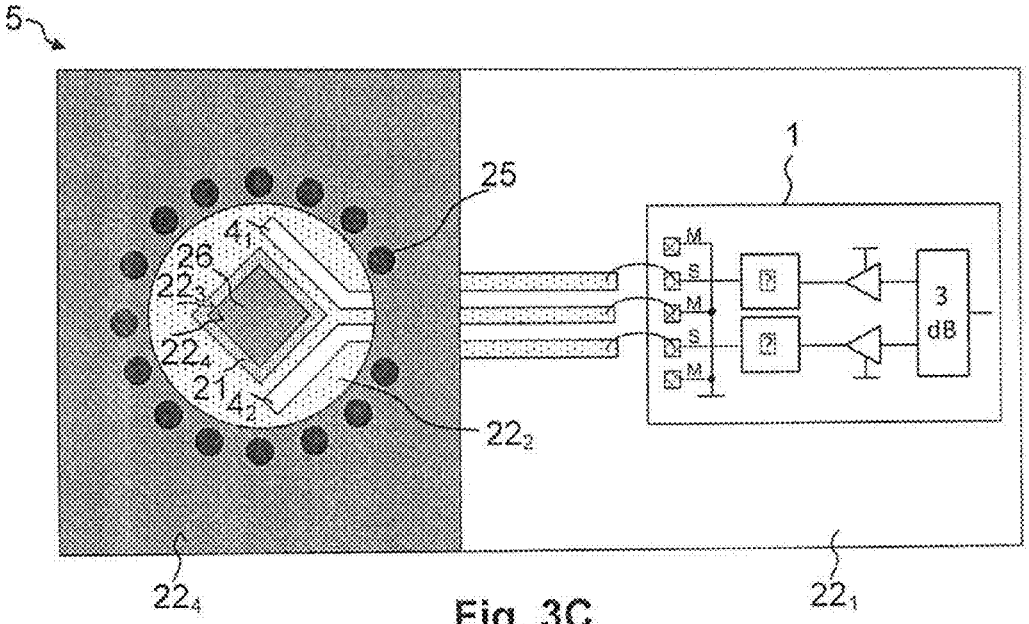
Figure 4A:
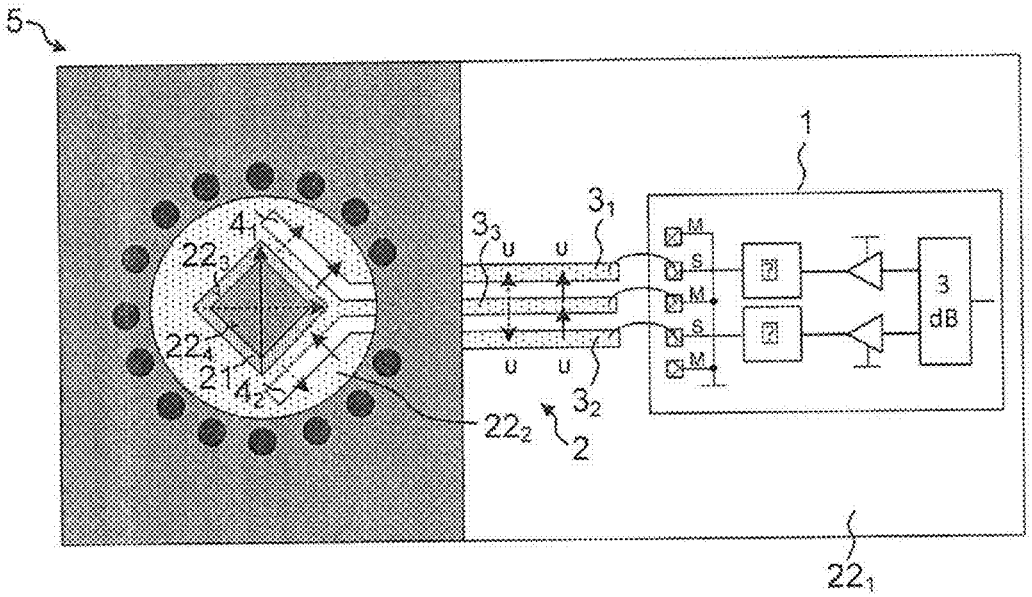
Figure 4B:
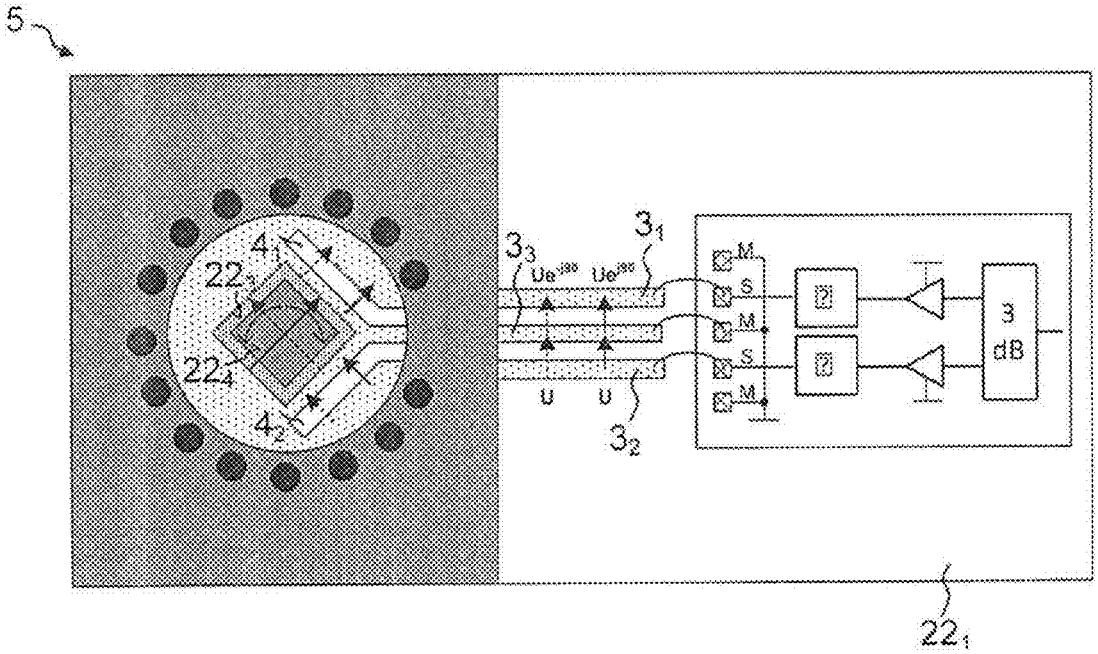

Various exemplary embodiments of the invention are described by way of example below with reference to the drawings. The same subject matters provide the same reference numbers. The corresponding figures in the drawings show in detail:

FIG. 1A an antenna of an exemplary embodiment with two ports, which is excited by an MMIC amplifier unit via a three-line system and radiates an electromagnetic field with a horizontal or vertical polarisation;

FIG. 1B an antenna of an exemplary embodiment with two ports, which is excited by an MMIC amplifier unit via a three-line system and radiates an electromagnetic field with a left-hand circular respectively right-hand circular polarisation;

FIG. 1C a sample exemplary structure of an MMIC amplifier unit for the excitation of an antenna for a horizontal or vertical or left-hand circular respectively right-hand circular polarisation;

FIG. 2A an exemplary embodiment of the printed-circuit board arrangement according to the invention, which comprises two antenna elements which are fed by a three-line system, and a first patch;

FIG. 2B a further exemplary embodiment of the printed-circuit board arrangement according to the invention, which comprises two antenna elements which are fed by a three-line system, and two patches;

FIG. 2C a further exemplary embodiment of the printed-circuit board arrangement according to the invention, which comprises two antenna elements which are fed by a three-line system, and a first patch radiating downwards;

FIG. 3A a plan view of the first and second metal layer of the printed-circuit board arrangement according to the invention;

FIG. 3B a further plan view of the first, second and third metal layer of an exemplary embodiment of the printed-circuit board arrangement according to the invention;

FIG. 3C a further plan view of the first, second, third and fourth metal layer of an exemplary embodiment of the printed-circuit board arrangement according to the invention;

FIG. 4A a further plan view of the first, second, third and fourth metal layer of the printed-circuit board arrangement according to the invention, explaining the functionality of the first patch in the case of a vertical or horizontal polarisation; and FIG. 4B a further plan view of the first, second, third and fourth metal layer of an exemplary embodiment of the printed-circuit board arrangement according to the invention, explaining the functionality of the patch in the case of a left-hand circular respectively right-hand circular polarisation.

FIG. 1A shows an antenna with two ports which is excited by an amplifier unit 1 via a three-line system 2 with a horizontal or vertical polarisation. The amplifier unit 1 is preferably an MMIC amplifier unit 1 (English: Monolithic Microwave Integrated Circuit; German: monolithischer Mikrowellenschaltkreis). The three-line system 2 preferably comprises three parallel lines, whereas voltages, which can differ in modulus and phase, are guided along the two lines $\mathbf{3}_1$, $\mathbf{3}_2$. In this context, the third line $\mathbf{3}_3$ serves as a reference ground and is also referred to as the middle line $\mathbf{3}_3$ and is used as a common line for the two lines $\mathbf{3}_1$, $\mathbf{3}_2$.

FIG. 1A shows that a first line $\mathbf{3}_1$ of the three-line system 2 is connected to the connecting port 1 of the antenna 4. A second line $\mathbf{3}_2$ connects the amplifier unit to the second connecting port of the antenna 4. The third line $\mathbf{3}_3$ is a ground line, which is also guided to the antenna 4. It is also evident that the antenna 4 in FIG. 1A radiates both a horizontal polarisation and also a vertical polarisation. In this context, the drawn-through arrows in FIG. 1A indicate two voltages which in fact have the same amplitude U, but their phase differs by 180°. As will be explained in detail below, with a line definition of this kind, the antenna 4 radiates a vertically polarised electromagnetic field. In the inverse case, which is marked with the dashed arrow, voltages which are identical in their amplitude and also their phase angle are fed to the antenna 4. The antenna 4 then radiates a horizontally polarised electromagnetic field.

However, it must also be stated that the respective polarisation is ultimately obtained exclusively from the arrangement of the excitation structures in the antenna 4 and from the arrangement of the antenna 4 in the reference system itself.

As will be explained in detail below, the structures of the antenna 4 and also the amplifier unit 1 illustrated in FIGS. 1A to 1C are imaged in their entirety on the printed-circuit board arrangement 5 according to the invention.

FIG. 1B shows an antenna 4 with two ports, which is excited by an amplifier unit 1 via a three-line system 2 with a circular polarisation. With regard to the structure, reference is made to the description for FIG. 1A. In FIG. 1B also, a voltage is applied to the first line $\mathbf{3}_1$ and the second line $\mathbf{3}_2$, which form the two outer lines of the three-line system 2. In this context, the amplitude of these two voltages generated by the amplifier unit 1 is identical. However, the phase of the voltage applied to the first line $\mathbf{3}_1$ is shifted by −90° in comparison to the phase of the voltage applied to the second line $\mathbf{3}_2$. In this case, the antenna 4 radiates a left-hand circular polarised electromagnetic field. This fact is indicated by the dashed arrows in FIG. 1B.

It is also possible for the voltage on the first line $\mathbf{3}_1$ to be shifted by +90° in comparison to the voltage on the second line $\mathbf{3}_2$. In this case, the antenna 4 radiates a right-hand circular polarised electromagnetic field. This fact is illustrated in FIG. 1B by the drawn-through arrows. Which phase displacement produces which circular polarisation here also ultimately depends upon the arrangement of the structures within the antenna 4 and the arrangement of the antenna 4 in the reference system itself. However, it must be stated that, with identical amplitude and a phase shift of −90° or a phase shift of +90°, an electromagnetic field which exhibits either a left-hand circular or a right-hand circular polarisation is radiated by the antenna 4.

Furthermore, the application case according to which a difference in the amplitude and also in the phase is present in the voltages on the first line $\mathbf{3}_1$ and the second line $\mathbf{3}_2$ is not illustrated. In this case, the antenna 4 radiates an electromagnetic field which exhibits either a left-hand or right-hand elliptical polarisation.

As a result of the fact that the amplifier unit 1 can generate voltages which provide a different phase angle and/or a different amplitude, and that these different voltages can be fed to the antenna 4 on the first line $\mathbf{3}_1$ and the second line $\mathbf{3}_2$ with the line $\mathbf{3}_3$ as a reference ground, electromagnetic waves which have a different polarisation are generated. As already explained, it is particularly advantageous if the amplifier unit 1 is constructed according to the MMIC principle, because as a result, the phase adjustment and/or amplitude adjustment can be manufactured via a three-line system 2 with a small space requirement and in a cost favourable manner, for example, in SiGe technology.

FIG. 1C shows an exemplary structure of an amplifier unit 1 for the excitation of an antenna 4 with horizontal or vertical or circular or elliptical polarisation. The amplifier unit 1 provides five connecting ports at the output end, which are embodied as bonding pads (pads) $\mathbf{6}_1$, $\mathbf{6}_2$, $\mathbf{6}_3$, $\mathbf{6}_4$, and $\mathbf{6}_5$. In this context, the pads $\mathbf{6}_1$, $\mathbf{6}_3$, and $\mathbf{6}_5$ are connected to ground, whereas different voltages are connected to the pads $\mathbf{6}_2$ and $\mathbf{6}_4$. As illustrated in detail below, the first line $\mathbf{3}_1$ is connected by means of a bonding process via bonding wires to the pad $\mathbf{6}_2$. The second line $\mathbf{3}_2$ is connected to the pad $\mathbf{6}_4$. The third line $\mathbf{3}_3$ is connected to the pad $\mathbf{6}_3$. A high-frequency signal to be amplified is supplied within the amplifier unit 1 to a 3-dB coupler 7. This 3-dB coupler splits the applied input signal into two output signals, which have the same amplitude and the same phasing. The first output signal is amplified via a first high-frequency amplifier $\mathbf{8}_1$, whereas a second output signal is amplified via a second high-frequency amplifier $\mathbf{8}_2$.

As illustrated in FIG. 1C, the gain factor of the first high-frequency amplifier $\mathbf{8}_1$ can be freely adjusted. The same applies for the gain factor of the second high-frequency amplifier $\mathbf{8}_2$. The amplified output signal of the first high-frequency amplifier $\mathbf{8}_1$ is supplied to a first phase shifter $\mathbf{9}_1$. The output of the first phase shifter $\mathbf{9}_1$ is connected to the second pad $\mathbf{6}_2$, which, in turn, is connected to the first line $\mathbf{3}_1$. The output signal of the second high-frequency amplifier $\mathbf{8}_2$ is applied to the input of a second phase shifter $\mathbf{9}_2$. The output of the second phase shifter $\mathbf{9}_2$ is connected to the fourth pad $\mathbf{6}_4$, which in turn is connected, to the second line $\mathbf{3}_2$.

The phase of the high-frequency signal to be amplified can be adjusted arbitrarily via the first phase shifter $\mathbf{9}_1$ and the second phase shifter $\mathbf{9}_2$. By preference, phase shifts of 0°, −90°, 90° and 180° are adjusted. The first phase shifter $\mathbf{9}_1$ and the second phase shifter $\mathbf{9}_2$ can be made up, for example, from capacitors and inductances, by means of which the phase shift is adjustable. Accordingly, horizontal and vertical polarisations can be achieved. Similarly, left-hand circular and right-hand circular polarisations can be achieved. An elliptical polarisation can be additionally achieved by varying the amplitude of the signal to be amplified by means of the first high-frequency amplifier $\mathbf{8}_1$ and the second high-frequency amplifier $\mathbf{8}_2$. The amplitude and the phase of the individual high-frequency signals to be amplified can be accurately adjusted in such a manner that even non-ideal affects which for example can be traced back to asymmetries in the line structure originated during the processing of the multi-layer, can be compensated.

FIG. 2A shows an exemplary embodiment of the printed-circuit board arrangement 5 according to the invention, which provides several antenna elements $\mathbf{4}_1$, $\mathbf{4}_2$ and a first patch 21 which are fed from the three-line system 2. The printed-circuit board arrangement 5 according to the invention comprises four metal layers $\mathbf{22}_1$, $\mathbf{22}_2$, $\mathbf{22}_3$, $\mathbf{22}_4$. The first metal layer $\mathbf{22}_1$ and the second metal layer $\mathbf{22}_2$ are arranged on the underside or on the upper side of a first substrate $\mathbf{23}_1$. The first substrate is a dielectric which electrically separates the first metal layer $\mathbf{22}_1$ from the second metal layer $\mathbf{22}_2$. The third metal layer $\mathbf{22}_3$ and the fourth metal layer $\mathbf{22}_4$ are disposed on the underside or on the upper side of a second substrate $\mathbf{23}_2$. The first substrate $\mathbf{23}_1$ and the second substrate $\mathbf{23}_2$ should provide dielectric constants which are suitable for high frequencies in the millimeter-wave range. The first substrate $\mathbf{23}_1$, which comprises the first metal layer $\mathbf{22}_1$ and the second metal layer $\mathbf{22}_2$, is separated from the second substrate $\mathbf{23}_2$, which comprises the third metal layer $\mathbf{22}_3$ and the fourth metal layer $\mathbf{22}_4$, by an interlayer 24. The interlayer is a PREPREG (English: pre impregnated fibres; German: vorimprägnierte Fasern), which provides dielectric properties similar to the first substrate $\mathbf{23}_1$ and the second substrate $\mathbf{23}_2$, whereas the melting temperature of the PREPREG is lower, so that, with a suitable temperature and a high compressive pressure, the two still solid substrates $\mathbf{23}_1$, $\mathbf{23}_2$ are glued to one another via the interlayer 24.

Furthermore, a recess 28 in which the amplifier unit 1 is inserted is embodied in the first substrate $\mathbf{23}_1$ of the printed-circuit board arrangement 5 according to the invention which carries the three-line system 2. This recess 28 is preferably created via a milling process, whereas the recess 28 should be selected to be so deep that the terminal contacts, that is, the pads $\mathbf{6}_1$ to $\mathbf{6}_5$ of the amplifier unit 1 are at the same level as the three-line system 2. Accordingly, FIG. 2A shows that the first metal layer $\mathbf{22}_1$ is significantly thicker than, for example, the second metal layer $\mathbf{22}_2$. The relatively greater thickness can be achieved, for example, by copper plating. This guarantees that the first metal layer $\mathbf{22}_1$ is not cut through, even in a milling process, and that the amplifier unit 1 can then be securely arranged in the recess 28. In order to create the recess 28 within the first substrate $\mathbf{23}_1$, the second substrate $\mathbf{23}_2$ with its two metal layers $\mathbf{22}_3$, $\mathbf{22}_4$ must preferably also be removed together with the interlayer 24 in the region of the recess 28. This can also be implemented by a punching process before pressing.

The antenna 4 preferably comprises two antenna elements $\mathbf{4}_1$, $\mathbf{4}_2$, which are coupled via the three-line system 2 to the amplifier unit 1. As will be described in detail below, the at least two antenna elements $\mathbf{4}_1$, $\mathbf{4}_2$ are slot antennas, whereas each slot antenna $\mathbf{4}_1$, $\mathbf{4}_2$ is formed respectively by an aperture on the second metal layer $\mathbf{22}_2$ of the printed-circuit board arrangement 5. These apertures, which are not illustrated in FIG. 2A, are continued from the antenna elements $\mathbf{4}_1$, $\mathbf{4}_2$ in direction towards the amplifier unit 1 and accordingly separate the three lines $\mathbf{3}_1$, $\mathbf{3}_2$, $\mathbf{3}_3$ extending parallel to one another, that is, the strip lines $\mathbf{3}_1$, $\mathbf{3}_2$, $\mathbf{3}_3$, electrically from one another. In this context, coupling is understood in that the three-line system 2 is converted into two slot lines, of which respectively one part forms an antenna element $\mathbf{4}_1$, $\mathbf{4}_2$, which is then a slot antenna $\mathbf{4}_1$, $\mathbf{4}_2$.

Moreover, a first patch 21 is embodied on the third metal layer $\mathbf{22}_3$ which is arranged above the two antenna elements $\mathbf{4}_1$, $\mathbf{4}_2$. This first patch 21, together with the two slot antennas $\mathbf{4}_1$, $\mathbf{4}_2$, achieves that an electromagnetic field is radiated upwards or respectively downwards, that is, primarily perpendicular to the first patch 21. In order to prevent this electromagnetic field from leaving the printed-circuit board arrangement 5 according to the invention in two directions, the first metal layer $\mathbf{22}_1$ in the exemplary embodiment from FIG. 2A is embodied as an enclosed metal layer, which therefore acts as a reflector and reflects the downwards propagating part of the electromagnetic field back upwards again.

Furthermore, in FIG. 2A, a via hole 25 is embodied, which connects the various metal layers $\mathbf{22}_1$ to $\mathbf{22}_4$ electrically to one another. The via hole 25 also serves to prevent parts of the electromagnetic field which are radiated from the antenna 4 from penetrating the printed-circuit board arrangement 5 laterally and coupling into further strip lines. For example, an antenna which functions as a receiver can also be embodied on the same printed-circuit board arrangement 5. In order to avoid a direct coupling of the feeding antenna 4 into the receiving antenna, the feeding antenna 4 is surrounded by via holes 25 and therefore shielded, as will be explained later.

FIG. 2B shows a further exemplary embodiment of the printed-circuit board arrangement 5 according to the invention which provides several antenna elements $\mathbf{4}_1$, $\mathbf{4}_2$ and two patches 21, 26, which are fed from a three-line system 2. The printed-circuit board arrangement 5 from FIG. 2B corresponds to the printed-circuit board arrangement 5 from FIG. 2A with the difference that a second patch 26 is embodied above the first patch 21. The two patches 21, 26 are electrically separated from one another by the second substrate $\mathbf{23}_2$. Furthermore, the two patches 21, 26 are electrically separated from the two antenna elements $\mathbf{4}_1$, $\mathbf{4}_2$ by the interlayer 24. The second patch 26 is embodied on the fourth metal layer $\mathbf{22}_4$, which is arranged above the two antenna elements $\mathbf{4}_1$, $\mathbf{4}_2$, whereas the second patch 26 is isolated by apertures within the fourth metal layer $\mathbf{22}_4$ from the latter. FIG. 2B also shows the recess 28 into which the amplifier unit 1 is inserted.

FIG. 2C shows a further exemplary embodiment of the printed-circuit board arrangement 5 according to the invention which provides several antenna elements $\mathbf{4}_1$, $\mathbf{4}_2$ which are fed from a three-line system 2 and provides a first patch 21 radiating downwards. In this exemplary embodiment, the first patch 21 is embodied on the first metal layer $\mathbf{22}_1$, which is arranged below the two antenna elements $\mathbf{4}_1$, $\mathbf{4}_2$, whereas the first patch 21 is isolated by apertures within the first metal layer $\mathbf{22}_1$ from the latter. In order to prevent the electromagnetic field which is radiated from the antenna 4, from leaving the printed-circuit board arrangement 5 according to the invention in two directions, the third metal layer $\mathbf{22}_3$ is about a completely enclosed metal layer. In the exemplary embodiment from FIG. 2C, the part of the electromagnetic field which leaves the antenna 4 upwards, that is, in the direction towards the third metal layer $\mathbf{22}_3$ and the fourth metal layer $\mathbf{22}_4$, is reflected back at the third metal layer $\mathbf{22}_3$. In this case, the electromagnetic field leaves the printed-circuit board arrangement 5 according to the invention only at its bottom. Accordingly, the direction of radiation can be influenced very simply by changing the arrangement of the first patch 21 and the enclosed metal layer.

FIG. 3A shows a plan view of the first and second metal layer $\mathbf{22}_1$, $\mathbf{22}_2$ of the printed-circuit board arrangement 5 according to the invention. The amplifier unit 1 of which the pads $\mathbf{6}_2$ to $\mathbf{6}_4$ developed as terminal contacts are connected via bond wires to the three-line system 2 is clearly evident. Furthermore, the first line $\mathbf{3}_1$, the second line $\mathbf{3}_2$ and the third line $\mathbf{3}_3$ of the three-line system 2, which are embodied on the first metal layer $\mathbf{22}_2$, are illustrated. Moreover, it is clearly evident that the first line $\mathbf{3}_1$ is separated from the third line $\mathbf{3}_3$ by an aperture. Furthermore, the second line $\mathbf{3}_2$ is also separated from the third line $\mathbf{3}_3$ by a further aperture. In this context, the first line $\mathbf{3}_1$, the second line $\mathbf{3}_2$ and the third line $\mathbf{3}_3$ run parallel to one another.

Furthermore, it is clearly evident that the at least two antenna elements $\mathbf{4}_1$, $\mathbf{4}_2$ are slot antennas $\mathbf{4}_1$, $\mathbf{4}_2$, and that each slot antenna $\mathbf{4}_1$, $\mathbf{4}_2$ is formed respectively by an aperture on the second metal layer $\mathbf{22}_2$ of the printed-circuit board arrangement 5 according to the invention. These two apertures continue from the antenna elements $\mathbf{4}_1$, $\mathbf{4}_2$ in the direction towards the amplifier unit 1, so that the three lines or respectively strip lines $\mathbf{3}_1$, $\mathbf{3}_2$, $\mathbf{3}_3$ extending parallel to one another are electrically separated from one another. Because of the use of a printed-circuit board arrangement 5, the first line $\mathbf{3}_1$, the second line $\mathbf{3}_2$ and the third line $\mathbf{3}_3$ are also strip lines $\mathbf{3}_1$, $\mathbf{3}_2$, $\mathbf{3}_3$.

It is also clearly evident that the two outer lines respectively strip lines $\mathbf{3}_1$, $\mathbf{3}_2$ of the three-line system 2, which also guide the excitation signals merge into the ground surface $\mathbf{22}_2$ in a region in front of the two antenna elements $\mathbf{4}_1$, $\mathbf{4}_2$, so that the three-line system 2 is converted from three parallel lines of finite width into two parallel slot lines. The ground plane $\mathbf{22}_2$ is embodied on the second metal layer $\mathbf{22}_2$ and connected to the reference ground. This ground plane $\mathbf{22}_2$ is embodied at least in the direction towards the amplifier unit 1 in a circular shape thereby avoiding any undesirable radiation at the transition from the three parallel lines of finite width to the two parallel slot lines. However, it is also possible for the ground plane $\mathbf{22}_2$ to be embodied as a whole in a rounded manner, especially as a circular.

The first antenna element $\mathbf{4}_1$ is preferably orientated orthogonally to the second antenna element $\mathbf{4}_2$. It is particularly advantageous that the first antenna element $\mathbf{4}_1$ has the same shape and the same length as the second antenna element $\mathbf{4}_2$.

It is also clearly evident in FIG. 3A that a plurality of through-contacts 25 are arranged in a rounded, especially circular ring and that these enclose the at least two antenna elements $\mathbf{4}_1$, $\mathbf{4}_2$. The circular ring comprising the plurality of through-contacts 25 provides no through-contacts 25 in direction towards the three-line system 2. As a result of this circular ring with the plurality of through-contacts 25, it is ensured that no electromagnetic field is radiated laterally from the two antenna elements $\mathbf{4}_1$, $\mathbf{4}_2$ and disturbs receiving antennas, which may optionally be arranged, for example, on the printed-circuit board arrangement 5 according to the invention.

Furthermore, it is clearly evident that the first metal layer $\mathbf{22}_1$ is arranged below the first antenna element $\mathbf{4}_1$ and the second antenna element $\mathbf{4}_2$ and is embodied as a completely enclosed metal layer which acts as a reflector. In this context, the first metal layer $\mathbf{22}_1$ which acts as a reflector is separated from the second metal layer $\mathbf{22}_1$ only by the first substrate $\mathbf{23}_1$.

FIG. 3B shows a further plan view of the first, second and third metal layer $\mathbf{22}_1$, $\mathbf{22}_2$, $\mathbf{22}_3$ of the printed-circuit board arrangement 5 according to the invention. It is evident that a first patch 21 is embodied on a third metal layer $\mathbf{22}_3$ which is arranged above the two antenna elements $4_1$, $4_2$. In this context, the third metal layer $22_3$ is separated from the second metal layer $22_2$ by the interlayer 24.

In the illustration, the first patch 21 has the shape of a square, whereas the shape of a rhombus is also possible. By preference, a first edge of the first patch 21 is arranged parallel to the first antenna element $4_1$, and a second edge of the first patch 21, which is adjacent to the first edge of the first patch 21, extends parallel to the second antenna element $4_2$. In this context, adjacent is understood in that the two edges touch at one point. This ensures that almost all points of the first edge of the first patch are at the same distance from the first antenna element $4_1$ and also that almost all points of the second edge of the first patch 21 are at the same distance from the second antenna element $4_2$. The same also applies for almost all points of the first edge and of the second edge relative to one another, which are always at approximately the same distance from the respective antenna element $4_1$, $4_2$.

By preference, the first antenna element $4_1$ and the second antenna element $4_2$ are arranged under the first patch 21. In the drawings, the antenna elements $4_1$, $4_2$ are also arranged with a horizontal and vertical spacing to the first and second edges of the first patch 21 in order to improve visual clarity. The same also applies if the first patch 21 is embodied on the first metal layer $22_1$, as illustrated in FIG. 2C. In this case, the first antenna element $4_1$ and the second antenna element $4_2$ are preferably arranged directly above the first patch 21.

FIG. 3C shows a further plan view of the first, second, third and fourth metal layer $22_1$, $22_2$, $22_3$, $22_4$ of the printed-circuit board arrangement 5 according to the invention. It is clearly evident that a second patch 26 is arranged above the first patch 21 which is arranged above the at least two antenna elements $4_1$, $4_2$, whereas the two patches 21, 26 are separated from one another by a dielectric $23_2$. In this context, the metal layer $22_4$ on which the second patch 26 is embodied, is provided with a recess, so that the second patch 26 is isolated from the remainder of the metal layer $22_4$. The remainder of the metal layer $22_4$ which does not form the second patch 26 is accordingly connected, inter alia, by the via hole 25 to the reference ground. The second patch 26 is separated from the first patch 21 by the second substrate $23_2$. By preference, the second patch 26 is arranged in such a manner above the first patch 21 that the mid-point of the second patch 26 is arranged directly, that is, perpendicularly above the mid-point of the first patch 21. By preference, the second patch 26 provides the shape of a square or a rhombus and accordingly preferably has the same shape as the first patch 21.

In this context, the edges of the second patch 26 have the same length, which is preferably shorter than or the same as the length of the edges of the first patch 21. As already described, the second patch 26 is arranged respectively orientated above the first patch 21 in such a manner that the edges of the second patch 26 extend as parallel as possible to the edges of the first patch 21.

The second patch 26 is spaced from the first patch 21 by a length such that the directional effect of the antenna arrangement with the patch 21 and the two antenna elements $4_1$, $4_2$ is increased. By preference, the length varies within the order of magnitude of $\lambda/4$, where the wavelength should be set in the material of the printed-circuit board arrangement. The aperture on the fourth metal layer $22_4$ which isolates the second patch 26 from the remainder of the metal layer $22_4$ is preferably selected in such a manner that the aperture extends from the second patch 26 up to the via holes 25, which are arranged in the shape of a ring. The outer contour of this recess is preferably embodied in a circular manner, so that it matches the via holes 25 arranged in the shape of a ring as closely as possible.

The use of a second patch 26, which is optional, also means that the useful bandwidth of the antenna 4 with the two antenna elements $4_1$, $4_2$ is increased. As already explained, the via holes 25 serve to shield the antenna 4 with the two antenna elements $4_1$, $4_2$, whereas these via holes 25 extend through the metal layers $22_1$, $22_2$ and $22_4$, so that the antenna 4 is framed by this circular edging. Only in the region of the two slot lines of the three-line system 2, which merge into the two antenna elements $4_1$ and $4_2$, this shielding is interrupted. In this manner, the antenna 4 with the two antenna elements $4_1$, $4_2$ radiates perpendicular to the metal layers $22_1$ to $22_4$.

FIG. 4A shows a further plan view of the first, second, third and fourth metal layer $22_1$ to $22_4$ of the printed-circuit board arrangement 5 according to the invention, where the functionality of the first patch 21 is explained for a vertical and/or horizontal polarisation. It is evident that the three-line system 2 is supplied on the one hand with a common-mode excitation and on the other hand with a differential-mode excitation. In the case of a common-mode excitation, the two supply voltages on the first line $3_1$ and the second line $3_2$ are identical in modulus and phase with reference to the third line $3_3$. This fact is illustrated by the dashed arrows in FIG. 4A.

In the case of the differential-mode excitation, the supply voltages on the first line $3_1$ and the second line $3_2$ in fact are identical in amplitude with reference to the third line $3_3$, but their phases differ by 180°. This fact is illustrated in FIG. 4A by the drawn-through arrows. Because of the fact that the first line $3_1$ and the second line $3_2$ on which the supply voltages are provided, merge into the ground surface $22_2$, the common-mode excitation for example leads to a horizontal polarisation of the radiated field, via the slot antennas $4_1$, $4_2$ arranged orthogonally in the proximity of the patch. It is evident, for example, that the field lines extend from the third line $3_3$ towards the second line $3_2$ or towards the first line $3_1$. Via the slot antennas, this leads to the vertical component being cancelled, because the amplitudes are identical in magnitude, so that only a horizontal component is preserved. This leads to a horizontal polarisation of the radiated field, as illustrated by the dashed arrow over the first patch 21.

The functionality when the three-line system is supplied with a differential-mode excitation can be explained by analogy. In this context, reference is made to the drawn-through arrows. Because of the phase difference of 180°, the horizontal components of the electromagnetic fields propagating via the two slot antennas $4_1$, $4_2$ are cancelled, so that the radiated electromagnetic field exhibits only a vertical polarisation. By switching between the two supply modes (common-mode supply, differential-mode supply) in the amplifier unit 1, it is therefore possible to switch directly between the two linear polarisations.

FIG. 4B shows a further plan view of the first, second, third and fourth metal layer $22_1$ to $22_4$ of the printed-circuit board arrangement 5 according to the invention, where the functionality of the first patch is explained in the case of a circular polarisation. As already explained, the supply voltages on the first line $3_1$ and the second line $3_2$ of the three-line system 2 differ in their phase, where the amplitude of these two supply voltages is identical. The dashed arrow explains the case that the phase of the individual supply voltages differs by −90°, whereas the drawn-through arrow describes the case that the phase of the two supply voltages differs by +90°. In this case, the respective horizontal or vertical components of the electrical fields are no longer completely cancelled via the first slot antenna $4_1$ and the second slot antenna $4_2$.

An excitation by means of these supply voltages leads, via the slot antennas 41, 42 arranged orthogonally in the proximity of the patch, to a left-hand circular polarisation or a right-hand circular polarisation of the radiated electromagnetic field. Accordingly, by switching between these two supply modes in the amplifier unit 1, it is possible to switch directly between the two circular polarisations. For the printed-circuit board arrangement 5 according to the invention as described, with a phase displacement of 0° between the two supply voltages on the first line $3_1$ and the second line $3_2$, a linear, horizontally polarised electromagnetic field is radiated, whereas, with a phase displacement of 180°, a linear vertically polarised electromagnetic field is radiated. If the phase shift in the arrangement described is −90°, a left-hand circular polarised electromagnetic field is radiated whereas, with a phase shift of +90°, a right-hand circular polarised field is radiated.

By changing the amplitude within the amplifier unit 1, it is possible to switch to an elliptical polarisation. However, the principle described can also be used, in general, for non-planar antennas and line structures.

Within the framework of the invention, all of the features described and/or illustrated can be combined with one another as required.

The invention claimed is:

1. A printed-circuit board arrangement comprising:

a printed-circuit board including a first metal layer, a second metal layer, and a third metal layer, the second metal layer being arranged below the third metal layer and arranged above the first metal layer, an amplifier unit; and at least two slot antennas formed respectively by apertures in the second metallic layer and coupled to the amplifier unit via a three-line system, wherein the three-line system includes three strip lines mounted on the printed-circuit board or introduced into the printed-circuit board extending parallel to one another, wherein voltages, which differ in modulus and phase, are guided along a first strip line and a second strip line of the three-line system, wherein a third strip line of the three-line system serves as a common ground line for the first strip line and the second strip line, wherein a first patch is embodied in the third metal layer, the first patch being excited from the three-line system, and wherein the apertures continue from the at least two slot antennas in a direction towards the amplifier unit and separate the three strip lines extending parallel to one another.

2. The printed-circuit board arrangement according to claim 1, wherein two outer strip lines of the three-line system merge in a region in front of the at least two slot antennas into a ground plane, where the three-line system is converted into two parallel slot lines.

3. The printed-circuit board arrangement according to claim 2, wherein the ground plane is arranged on the second metallic layer, and wherein the ground plane is embodied in a rounded manner at least in a direction towards the amplifier unit, thereby avoiding any undesirable radiation at a transition from the three strip lines of finite width extending parallel to one another to the two parallel slot lines.

4. The printed-circuit board arrangement according to claim 1, wherein a part of a first aperture which forms a first slot antenna is orthogonal to a part of a second aperture which forms a second slot antenna, and wherein the first slot antenna has a same shape and a same length as the second slot antenna.

5. The printed-circuit board arrangement according to claim 1, wherein a plurality of via holes are arranged on a ring and enclose the at least two slot antennas, and wherein the ring provides no via hole in a direction towards the three-line system.

6. The printed-circuit board arrangement according to claim 1, wherein the first patch has a shape of a square or a rhombus, wherein a first edge of the first patch extends parallel to a first slot antenna, and wherein a second edge of the first patch which is adjacent to the first edge of the first patch extends parallel to a second slot antenna.

7. The printed-circuit board arrangement according to claim 6, wherein the first edge of the first patch and the second edge of the first patch have at least approximately a same length as a first slot antenna and a second slot antenna of the at least two slot antennas, and wherein the first slot antenna is arranged below the first patch, and the second slot antenna is arranged below the first patch.

8. The printed-circuit board arrangement according to claim 1, wherein a second patch is arranged above the first patch which is arranged above the at least two slot antennas, and wherein the first and second patches are separated from one another by a dielectric.

9. The printed-circuit board arrangement according to claim 8, wherein a mid-point of the second patch is disposed directly above a mid-point of the first patch, wherein the second patch has a shape of a square or a rhombus, wherein edges of the second patch have at least approximately the same length as or are smaller than edges of the first patch, wherein the second patch is orientated above the first patch in such a manner that edges of the second patch extend parallel to the edges of the first patch, and wherein the second patch is spaced from the first patch by a vertical length, whereby directivity and a usable bandwidth of the at least two slot antennas are improved.

10. The printed-circuit board arrangement according to claim 1, wherein an enclosed metal layer which acts as a reflector is arranged above or below the at least two slot antennas, opposite to the first patch.

11. The printed-circuit board arrangement according to claim 1, wherein a recess is embodied in a first substrate of the printed-circuit board arrangement, which carries the three-line system, and wherein the amplifier unit is inserted into the recess.

12. The printed-circuit board arrangement according to claim 1, wherein the amplifier unit is a monolithic microwave integrated circuit of which terminal contacts are connected via bonding wires to the three-line system on the printed-circuit board arrangement, and wherein the terminal contacts are at least approximately at the same height as the three-line system.

13. The printed-circuit board arrangement according to claim 8, wherein the amplifier unit is embodied to apply respectively a signal to two outer lines with a middle line as a common line of the three-line system, so that the at least two slot antennas together with the first patch or together with the first patch and with the second patch radiate an electromagnetic field with at least one of a horizontal polarisation, a vertical polarisation, a left-hand circular polarisation, or a right-hand circular polarisation.

14. The printed-circuit board arrangement according to claim 1, wherein the at least two slot antennas are orientated orthogonally relative to one another.

* * * * *